United States Patent [19]

Takahashi et al.

[11] Patent Number: 4,957,143

[45] Date of Patent: Sep. 18, 1990

[54] REED OPERATING SYSTEM FOR LOOM

[75] Inventors: Takao Takahashi, Hachioji; Takatsugu Kato; Shigero Terushima, both of Tokyo, all of Japan

[73] Assignee: Nissan Motor Co., Ltd., Yokohama, Japan

[21] Appl. No.: 213,955

[22] Filed: Jul. 1, 1988

[30] Foreign Application Priority Data

Jul. 8, 1987 [JP] Japan ..... 62-103798[U]

[51] Int. Cl.[5] ..... D03D 49/00

[52] U.S. Cl. ..... 139/190

[58] Field of Search ..... 139/26, 190

[56] References Cited

U.S. PATENT DOCUMENTS

| | | | |
|---|---|---|---|
| 3,339,589 | 9/1967 | Gotz et al. | 139/26 |
| 4,127,150 | 11/1978 | Steverlynck | 139/449 |
| 4,494,578 | 1/1985 | Cech et al. . | |
| 4,566,498 | 1/1986 | Williams et al. | 139/26 |

FOREIGN PATENT DOCUMENTS

| | | | |
|---|---|---|---|
| 348468 | 2/1922 | Fed. Rep. of Germany . | |
| 1535590 | 7/1969 | Fed. Rep. of Germany . | |
| 2218205 | 11/1972 | Fed. Rep. of Germany . | |
| 2343106 | 4/1974 | Fed. Rep. of Germany . | |
| 2486550 | 1/1982 | France . | |
| 155008 | 5/1982 | German Democratic Rep. . | |
| 56-49050 | 5/1981 | Japan . | |
| 8005031 | 4/1982 | Netherlands | 139/26 |
| 1380518 | 1/1975 | United Kingdom . | |
| 1392855 | 4/1975 | United Kingdom . | |

*Primary Examiner*—Andrew M. Falik

*Attorney, Agent, or Firm*—Foley & Lardner, Schwartz, Jeffery, Schwaab, Mack, Blumenthal & Evans

[57] ABSTRACT

A reed operating system for a loom of the type wherein the advance position of a reed is altered. The reed operating system is comprised of a generally V-shaped swingable link through which the movement of a crank is transmitted to a sley sword to make swinging motion of the reed. The swingable link is rotatably mounted on and swingable around a pivot shaft which is mechanically connected to a hydraulic cylinder. The hydraulic cylinder so operates as to shift the position of the pivot shaft in a predetermined distance in a predetermined direction in accordance with a predetermined pattern, thus altering the advance position of the reed while hardly altering the backdown position of the reed.

6 Claims, 6 Drawing Sheets

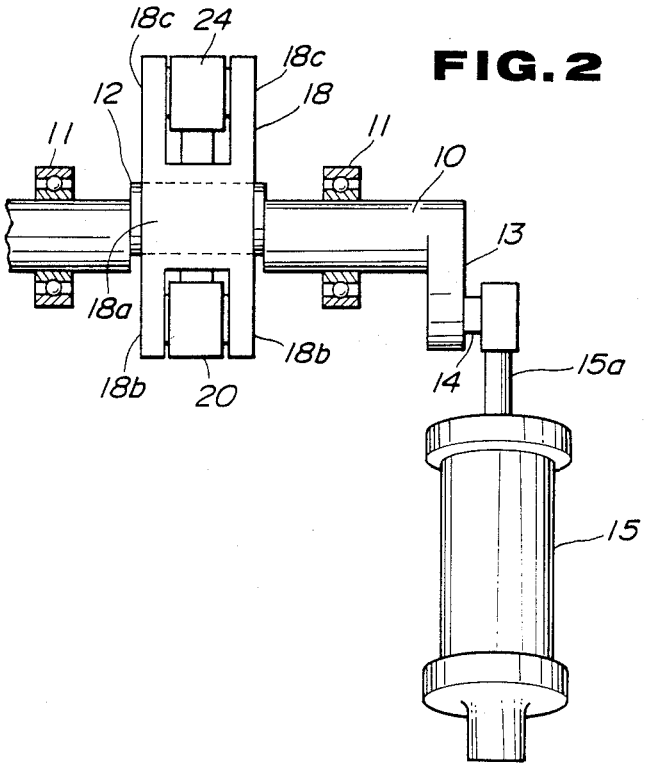
FIG. 2
FIG. 3
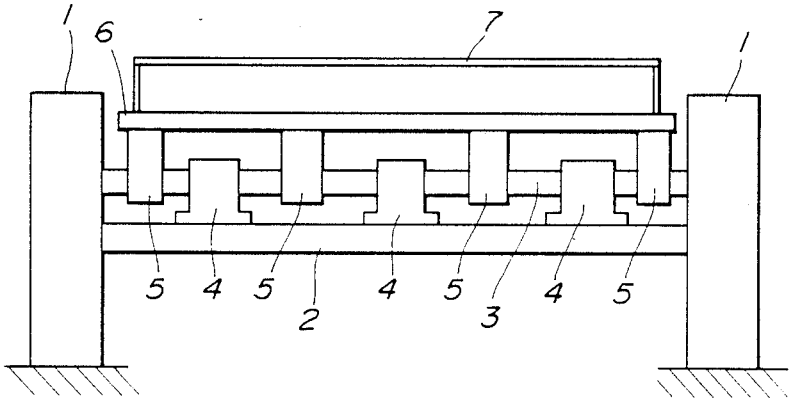

REED OPERATING SYSTEM FOR LOOM

BACKGROUND OF THE INVENTION

1. Field of the Invention

This invention relates generally to a reed operating system for a loom, and more particularly to a mechanism for altering the advance position of a reed without largely altering the backdown position of the reed.

2. Description of the Prior Art

A variety of reed operating systems for weaving looms have been proposed and put into practical use. Typical one of them is schematically shown in FIG. 8. The reed operating system in FIG. 8 includes a driving cam 101 rotatably mounted to a frame of a loom. A swingable lever 102 is swingably driven through a cam follower 102*a* by the driving cam 101. The swingable lever 102 is pivotted at its pivot section 102*b*. A sley sword 103 is pivotted at the common pivot section 102*b* and provided with a reed 104. The sley sword 104 functions to beat up a picked weft yarn against a cloth fell 106 of a woven fabric 107 which is contiguous with shedded warp yarns 105. Additionally, links 108 and 109 are connected with each other by a connecting pin 110. The link 108 is connected at its free end section with the free end section 102*c* of the lever 102, while the link 109 is connected at its free end section with a middle projection 103*a* of the sley sword 103. With such a reed operating system, the advance (bearing-up) position of the reed 104 is suitably set by selecting the location of the connecting pin 110.

However, the above-discussed conventional reed operating system is such configurated as to fundamentally alter the length of a connecting rod constituted of the links 108, 109 or an angle between the lever 102 and the sley sword 103 by selecting the location of the connection pin 110. Therefore, if the advance position of the reed 104 is altered from $A_1$ to $B_1$ in FIG. 8, the backdown position of the reed is also unavoidably altered from $A_2$ to $B_2$. Such alteration of the advance and backdown positions of the reed determines that a time period in which weft picking is possible is within an angle $\theta$ corresponding to a region between $B_2$ and $A_1$, thereby reducing the weft picking possible time period.

In order to prevent the weft picking possible time period or angle $\theta$ from reducing, it is necessary that the altered backdown position $B_2$ is near the previous backdown position $A_2$ even in case the advance position of the reed is altered from $A_1$ to $B_1$. Additionally, for the above arrangement in which the backdown position of the reed is altered, it is necessary to set the operation of a shedding motion in conformity with the backdown position of the reed at the time the length of the connecting rod becomes the smallest. This unavoidably enlarges the size of a warp shed.

SUMMARY OF THE INVENTION

It is an object of the present invention to provide an improved reed operating system which is suitable for high speed loom operation and arranged such that the advance position of a reed can be altered without a considerable alteration of the backdown position of the reed.

According to the present invention, the reed operating system for a loom comprised of a swingable link through which a sley sword is connected to a crank for driving a reed which is fixedly connected to the sley sword. The swingable link is rotatably mounted on and swingable around a pivot shaft. The location of the pivot shaft is altered in a predetermined distance in a predetermined direction in accordance with a predetermined pattern.

Accordingly, the movement of the crank is transmitted through the swingable link to the sley sword thereby to make swinging motion of the reed. The advance position of the reed can be altered by selecting the location of the pivot shaft of the swingable link. In other words, the advance position of the reed is altered by changing the swinging center of the swingable link.

In the reed operating system of the present invention, only the advance position of the reed is altered without a considerable alteration of the backdown position of the reed. Therefore, a weft picking possible angle $\theta$ is hardly altered even upon alteration of the reed advance position, thereby maintaining a larger weft picking possible angle $\theta$. Thus, the loom equipped with the reed operating system of the present invention is suitable for high speed loom operation. Furthermore, since the reed backdown position is hardly altered, the size of a warp shed is not so enlarged.

BRIEF DESCRIPTION OF THE DRAWINGS

In the drawings, the same reference numerals designate the corresponding elements and parts throughout all the figures, in which:

FIG. 2 is a fragmentary front elevation of an essential part of the reed operating system of FIG. 1;

FIG. 3 is a schematic front elevation of a loom equipped with the reed oprating system of FIG. 1;

DETAILED DESCRIPTION OF THE INVENTION

Figure 1:
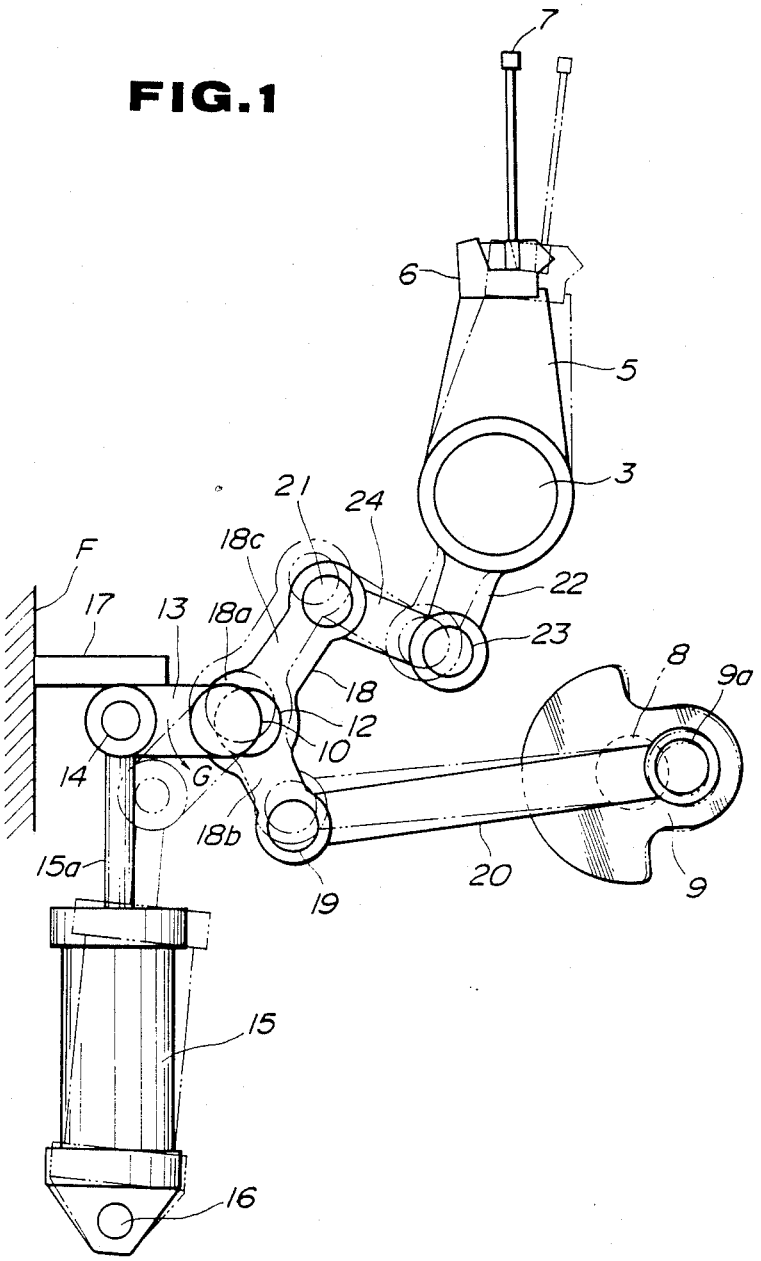
FIG. 1 is a side elevation of an embodiment of a reed operating system for a loom, in accordance with the present invention.

Referring now to FIGS. 1 to 5, there is shown an embodiment of a reed operating system for a weaving loom, in accordance with the present invention. The reed operating system is incorporated in the weaving loom having a frame F. The frame F includes a pair of opposite sections 1, 1 between which a stay 2 extends to connect the opposite sections 1, 1. A sley sword shaft 3 is rotatably supported by bearing members 4 which are fixed to the stay 2. Sley swords 5 are rotatably mounted on the sley sword shaft 3. A reed holder 6 is fixedly secured to the free ends of the sley swords 5 and securely holds a reed 7 in such a manner as to move with the reed holder 6.

A crank 9 is fixedly mounted on a rotating shaft 8 which is rotatable in timed relation to a main shaft (not shown) of the loom. The crank 9 has a crank pin 9*a* which rotates around the rotating shaft 8. A pivot shaft 10 is rotatably supported to a fixed member (not shown) of the loom by means of bearing members 11 as shown in FIG. 2. The pivot shaft 10 is integrally formed with an eccentric shaft 12 which is eccentric relative to the pivot shaft 10. The pivot shaft 10 is integrally formed at its one end with an arm 13 which extends perpendicular to the axis of the pivot shaft 10. A pin 14 is projected from the free end of the arm 14 in such a manner as to be parallel with the axis of the pivot shaft 10. Pivotally connected to the pin 14 is the end section of a piston rod 15a of a hydraulic cylinder 15. The hydraulic cylinder 15 is secured to a fixed member (not shown) of the loom by means of a pin 16 in such a manner as to be slightly pivotable around the pin 16. A stopper 17 (in FIG. 1) for the arm 13 is provided to be secured to the loom frame F, so that the arm 13 can be brought into contact with the stopper 17.

A swingable link 18 having a generally V-shaped cross-section (in FIG. 1) is pivotally mounted on the eccentric shaft 12. More specifically, the link 18 has a central section 18a which is pivotally mounted on the eccentric shaft 12. Two opposite lower arm sections 18b are integral with and extend from the central section 18a. Two opposite upper arm sections 18c are integral with and extend from the central section 18a. Each lower arm section 18b and each upper arm section 18c are so arranged that the axes of them intersects to form an acute angle. A pin 19 is secured to connect the lower arm sections 18b at the free end. A pin 21 is secured to connect the upper arm sections 18c at the free end. The pin 19 is connected through a connecting rod 20 with the crank pin 9a of the crank 9. The pin 21 is connected through a connecting rod 24 with a pin 23 secured to a lever 22 which is projected downwardly from the sley sword 5. The lever 22 projects generally in the opposite direction to the sley sword 5 with respect to the sley sword shaft 3.

The manner of operation of the thus arranged reed operating system will be discussed.

Figure 4:
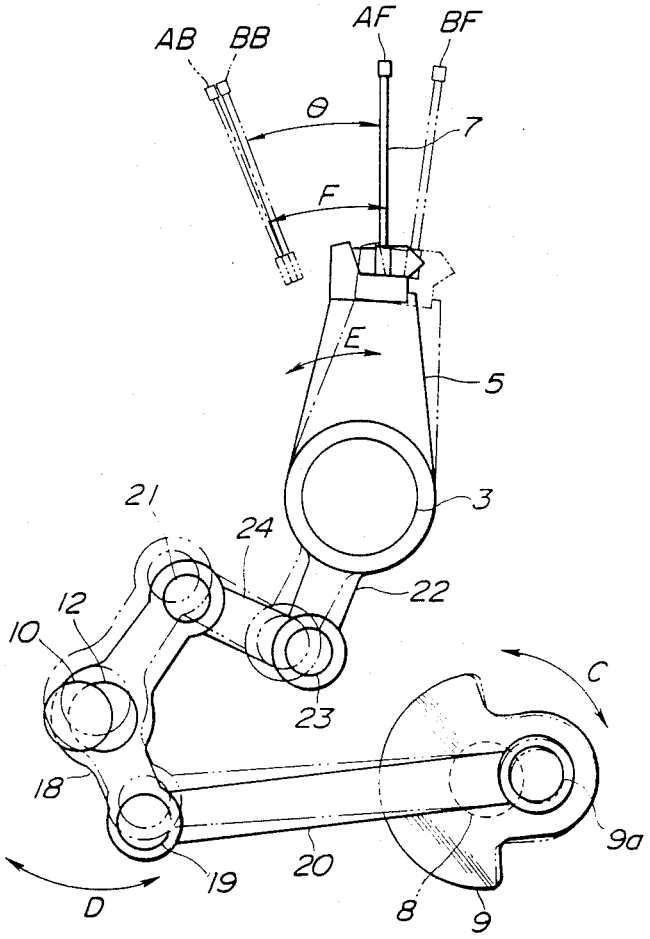
FIGS. 4 and 5 are side elevations similar to FIG. 1 but illustrating the operation of the reed operating system of FIG. 1.

When the rotating shaft 8 rotates in the direction of an arrow C in FIG. 4, the crank 9 rotates together in the same direction, so that the swingable link 18 swings around the eccentric shaft 12 in the direction of an arrow D in FIG. 4 through the crank pin 9a, the connecting rod 20, and the pin 19. Accordingly, the sley sword 5 is rotated in the direction of an arrow E in FIG. 4 through the pin 21, the connecting rod 24, the pin 23 and the lever 22, so that the reed 7 also swings in the directions of a two-headed arrow F in FIG. 4. In such an operation, FIGS. 1 and 4 shows a state in which the reed 7 reaches its advance position for accomplishing beating-up, while FIG. 5 shows another state in which the reed 7 reaches its backdown position or rear-most position.

Figure 5:
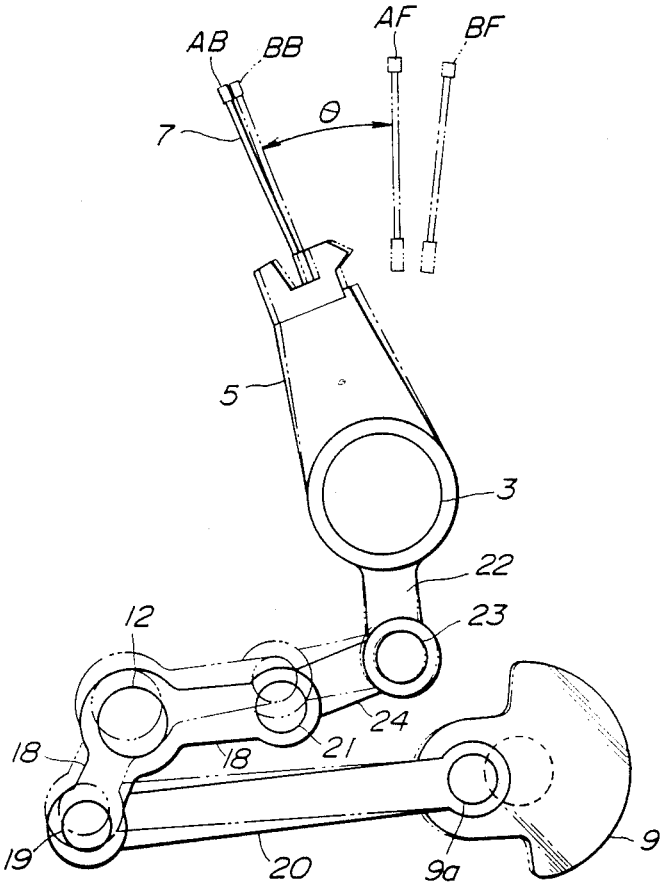

The states indicated by solid lines in FIGS. 1, 4 and 5 are established by the hydraulic cylinder 15 in a state indicated by solid lines in FIG. 1. When the piston rod 15a of the hydraulic cylinder 15 is withdrawn as indicated in phantom (or by dash-dot-dot lines) from the above state, the arm 13 rotates around the pivot shaft 10 in the direction of an arrow G and therefore the eccentric shaft 12 rotates together. As a result, a link system of this reed operating system is changed from the state indicated by the solid lines to the state indicated in phantom. This operation of the state changing is the same also in FIGS. 4 and 5.

Thus, the advance position of the reed 7 is changed to be further advanced as shown in FIG. 4 when the piston rod 15a of the hydraulic cylinder 15 is withdrawn as indicated in phantom in FIG. 1. However, the backdown position of the red 7 is not so changed as indicated in phantom in FIGS. 5. The operation of the hydraulic cylinder 15 to vertically move the piston rod 15a is carried out in accordance with a predetermined pattern. For example, in case of a pile fabric weaving loom, the predetermined pattern is such that two times beating-up are continuously made in the state of the solid lines and subsequently one time beating-up is made in the state shown in phantom. It will be understood that the hydraulic cylinder 15 is operated to accomplish the predetermined pattern under the action of a control device (not shown) which is known per se. In other words, the control device causes the hydraulic cylinder 15 to operate in accordance with the predetermined pattern.

Otherwise in order to remove filling bar, the predetermined pattern may be such that beating-up is made in the state shown in phantom in a time period during loom starting and thereafter beating-up is made in the state of the solid lines. Conversely the predetermined pattern may be such that beating-up is made in the state of the solid lines in the time period during loom starting and thereafter beating-up is made in the state shown in phantom. It will be understood that the states indicated by solid lines and in phantom are adjustable by suitably selecting a rotating amount of the pivot shaft 10 and/or an eccentric degree of the eccentric shaft 12 relative to the pivot shaft 10.

Next discussion will be made in case where the reed operating system of the present invention is applied to the pile fabric weaving loom which is operated in accordance with the above predetermined pattern.

When the piston rod 15a of the hydraulic cylinder 15 projects as indicated by the solid lines in FIG. 1, the arm 13 rotates upwardly to come into contact with the stopper 17. In the state of the solid lines, the swingable link 18 swings around the eccentric shaft 12 under rotation of the crank 9, thereby causing the sley sword 5 and the reed 7 to swing forward and rearward. At this time, the pivot shaft 10 and the eccentric shaft 12 are located in the positions of the solid lines, and therefore the reed 7 swings between the advance position AF and the backdown position AB as shown in FIGS. 4 and 5. Under this state, beating-up is made two times, and thereafter the piston rod 15a of the hydraulic cylinder 15 is withdrawn by a timing of the next beating-up thereby to shift the eccentric shaft 12 into the position shown in phantom. This moves the eccentric shaft 12 upwardly, so that the advance position BF largely shifts forward relative to the above-mentioned advance position AF, in which the backdown position BB only slightly shifts forward relative to the backdown position BB. Under this state, the reed 7 swings between the advance position BF and the backdown position BB. Accordingly at this time, beating-up is made at the advance position BF with two weft yarns beated up at the advance position AF. Thus, pile yarn projects in loop-shape as same as in known pile fabric weaving looms. During a time between this beating-up and the next beating-up, the piston rod 15a of the hydraulic cylinder 15 is projected thereby to restore the eccentric shaft 12 into the position of the solid lines.

Accordingly in this case, weft picking is accomplished within a weft picking possible angle $\theta$ formed between the reed 7 at the advance position AF and the reed 7 at the backdown position BB. In this connection, according to the present invention, the shifting amount of the reed 7 from the backdown position AB to the backdown position BB is less and therefore a larger weft picking possible angle $\theta$ can be obtained than in case of conventional reed operating systems. As a result, weft picking can be securely accomplished even at a high loom operational speed. Furthermore, since the shifting amount between the backdown positions AB, BB is smaller, the size of warp shed is nearly the same in both cases of being decided in accordance with the backdown position AB and with the other backdown position BB. As a result, according to the present invention, the size of the warp shed cannot be enlarged over a desired size.

Figure 6:
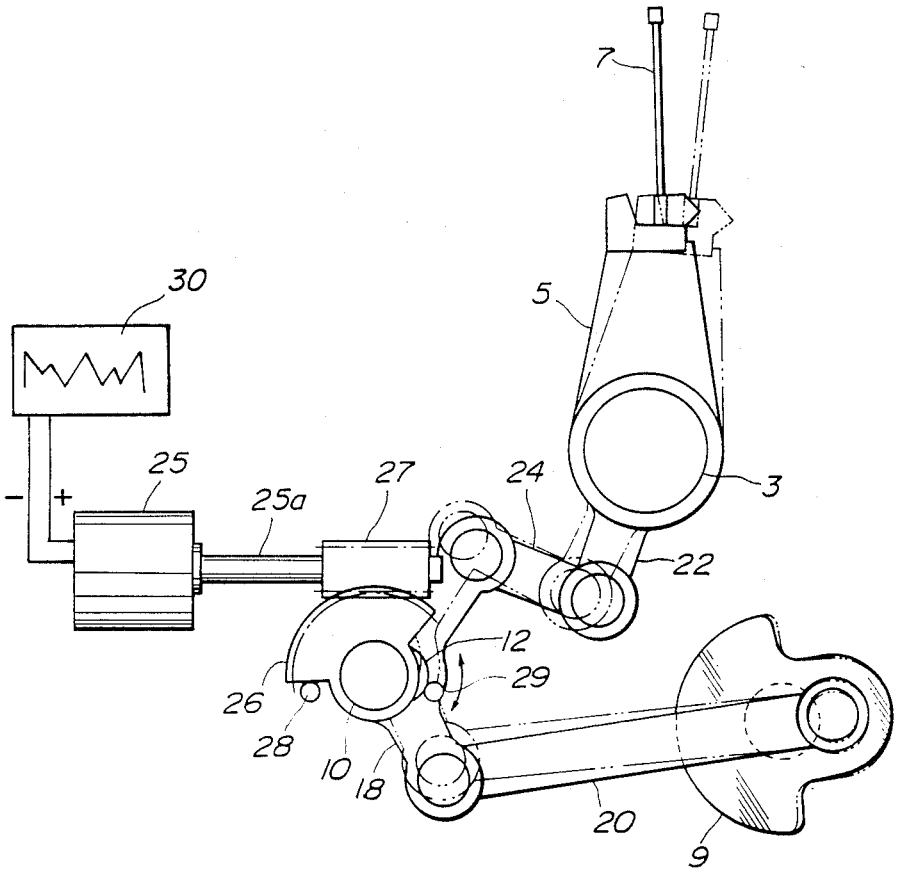
FIG. 6 is a side elevation similar to FIG. 1 but showing another embodiment of the reed operating system in accordance with the present invention.
Figure 7:
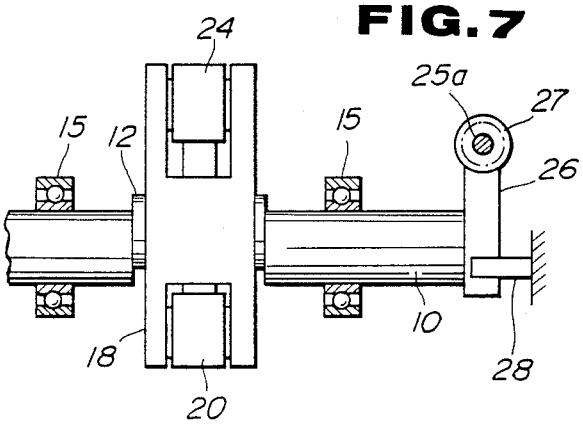
FIG. 7 is a fragmentary front elevation of an essential part of the reed operating system of FIG. 6.
Figure 8:
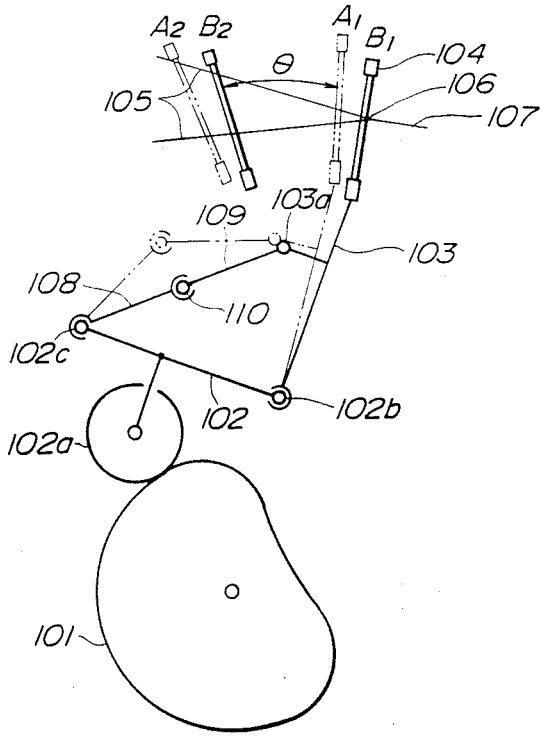
FIG. 8 (PRIOR ART)
FIG. 8 is a schematic illustration of a conventional reed operating system for a loom.

FIGS. 6 and 7 illustrate another embodiment of the reed operating system in accordance with the present invention, which is similar to the embodiment of FIGS. 1 to 5 except for a mechanism for shifting the location of the pivot shaft 10. In this embodiment, a sector gear 26 serving as a worm wheel is fixedly mounted on the end portion of the pivot shaft 10 in such a manner as to be coaxial with the pivot shaft 10. A worm gear 27 fixedly mounted on an output shaft 25*a* of a servo-motor 25 is engaged with the sector gear 26. Accordingly, the pivot shaft 10 is rotated to shift the location of the eccentric shaft 12 by operating the servo-motor 25. The reference numerals 28, 29 denote stoppers which are brought into contact with the both side ends of the sector gear 26. In this connection, the servo-motor 25 is arranged such that its operation or rotation is stopped when the rotational resistance of the motor 25 increases upon the sector gear 26 comming into contact with the stopper 28, 29. Otherwise, an encoder (not shown) may be provided to detect the rotational amount of the servo-motor 25 so as to stop the servo-motor 25 upon reaching a predetermined rotational position. It will be appreciated that this embodiment can demonstrate the same advantageous effects as in the embodiment of FIGS. 1 to 5.

While two mechanisms have been shown and described as rotating the pivot shaft 10, it will be understood that a lever may be fixedly mounted on the pivot shaft 10 and operated by a cam which rotates in timed relation to the main shaft of the loom.

In addition, in the above-discussed embodiments, it is possible that the length of pile of a pile fabric is varied by suitably selecting the advance position BF of the reed 7 upon suitable selection of the location of the pivot shaft 10, thereby obtaining high decorative pile fabric having piles of different lengths.

What is claimed is:

1. A reed operating system for a loom, comprising:

a crank for driving a reed between an advance position and a backdown position;

a swingable link through which said sley sword is connected to said crank;

a pivot shaft on which said swingable link is mounted so as to be swingably rotatable around an axis of said pivot shaft, said pivot shaft including a first shaft section, and a second shaft section on which said link is mounted, said second shaft section being eccentric relative to said first shaft section;

pattern means;

means for shifting and fixing location of said pivot shaft in a predetermined distance in a predetermined direction in accordance with a predetermined pattern whereby the advance position of the reed can be changed without substantially changing the backdown position, said pivot shaft location shafting and fixing means including a servo-motor, means for driving said servo-motor in accordance with said predetermined pattern, a sector gear fixed to said pivot shaft first section, and a worm gear engaged with said sector gear and driven by an output shaft of said servo-motor.

2. A reed operating system as claimed in claim 1, wherein said link includes a central section rotatably mounted on said pivot shaft, a first arm section integral with said central section and connected through a first connecting rod with said crank, and a second arm section integral with said central section and connected through a second connecting rod with said sley sword.

3. A reed operating system as claimed in claim 2, wherein said first arm section is angular to said second arm section.

4. A reed operating system as claimed in claim 2, further comprising a sley sword lever fixedly connected to said sley sword and located opposite to said sley sword with respect to a sley sword shaft around which said sley sword is swingable.

5. A reed operating system as claimed in claim 4, wherein an end of said sley sword lever is movably connected to an end of said second connecting rod.

6. A reed operating system as claimed in claim 1, further including stoppers for limiting the rotation of the sector gear.

* * * * *